US008061141B2

(12) United States Patent
Johnson et al.

(10) Patent No.: US 8,061,141 B2
(45) Date of Patent: Nov. 22, 2011

(54) COMBUSTOR ASSEMBLY INCLUDING ONE OR MORE RESONATOR ASSEMBLIES AND PROCESS FOR FORMING SAME

(75) Inventors: Clifford E. Johnson, Orlando, FL (US); Joachim Lepers, Düsseldorf (DE); Samer P. Wasif, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 1082 days.

(21) Appl. No.: 11/862,426

(22) Filed: Sep. 27, 2007

(65) Prior Publication Data

US 2009/0084100 A1 Apr. 2, 2009

(51) Int. Cl.
*F02C 7/24* (2006.01)

(52) U.S. Cl. ..... 60/725; 60/752

(58) Field of Classification Search ..... 60/725, 60/752; 431/114

See application file for complete search history.

(56) References Cited

U.S. PATENT DOCUMENTS

| | | | | |
|---|---|---|---|---|
| 4,100,993 | A | 7/1978 | Feder | |
| 5,276,291 | A * | 1/1994 | Norris | 181/224 |
| 5,353,598 | A * | 10/1994 | Huck et al. | 60/725 |
| 5,542,246 | A * | 8/1996 | Johnson et al. | 60/755 |
| 6,082,111 | A | 7/2000 | Stokes | |
| 6,530,221 | B1 | 3/2003 | Sattinger et al. | |
| 6,698,206 | B2 * | 3/2004 | Scarinci et al. | 60/725 |
| 6,837,051 | B2 | 1/2005 | Mandai et al. | |
| 6,959,550 | B2 * | 11/2005 | Freeman et al. | 60/725 |
| 6,973,790 | B2 * | 12/2005 | Suenaga et al. | 60/725 |
| 7,080,514 | B2 | 7/2006 | Bland et al. | |
| 7,080,515 | B2 | 7/2006 | Wasif et al. | |
| 7,089,741 | B2 | 8/2006 | Ikeda et al. | |
| 7,194,862 | B2 | 3/2007 | Sattinger | |
| 2005/0016178 | A1 | 1/2005 | Wasif et al. | |
| 2005/0166596 | A1 | 8/2005 | Sattinger | |
| 2007/0102235 | A1 | 5/2007 | Tobik et al. | |
| 2007/0125089 | A1 | 6/2007 | Sattinger | |
| 2009/0084100 | A1 | 4/2009 | Johnson et al. | |

FOREIGN PATENT DOCUMENTS

| | | | |
|---|---|---|---|
| DE | 102006040760 | A1 | 3/2008 |
| EP | 1666795 | A1 | 6/2006 |
| EP | 2017826 | A2 | 1/2009 |

* cited by examiner

*Primary Examiner* — Ted Kim

(57) ABSTRACT

A combustor assembly is provided comprising a combustor casing; a liner coupled to the combustor casing; a burner assembly coupled to the combustor casing; and at least one resonator assembly. The resonator assembly comprises a resonator outer plate having at least one opening, a resonator side wall coupled to the resonator outer plate, and a resonator inner plate defined by a portion of the liner. The resonator inner plate is coupled to the resonator side wall and has at least one slot formed therein having an aspect ratio of at least 4:1.

20 Claims, 5 Drawing Sheets

COMBUSTOR ASSEMBLY INCLUDING ONE OR MORE RESONATOR ASSEMBLIES AND PROCESS FOR FORMING SAME

FIELD OF THE INVENTION

The present invention relates to a combustor assembly including one or more resonator assemblies and a process for forming same.

BACKGROUND OF THE INVENTION

Gas turbine engines including a can-annular combustion system comprise a compressor and a turbine. The can-annular combustion system comprises a plurality of combustor assemblies and a like number of transition ducts. In one design, these combustor assemblies comprise a combustor casing, a burner assembly, and a combustor liner. Each transition duct connects a corresponding combustor liner to an inlet of the turbine. Compressed air enters each combustor assembly from the compressor, and is mixed with fuel in the burner assembly. The fuel and air mixtures burns within the combustor liner and transition duct, and the combustion products exit the transition duct into the turbine. The coupling of heat release oscillations with the acoustics of the combustor assembly is known to cause combustor acoustic pressure oscillations. These pressure oscillations can occur over a wide range of frequencies, depending upon the geometry of the combustor assembly and the heat release profile within the combustor assembly. These pressure oscillations in the combustor assembly can cause high cycle fatigue, leading to reduced life of combustion assembly components or restricted engine operation.

One known method for controlling combustion acoustic pressure oscillations is to incorporate Helmholtz resonator assemblies into the liner. These resonator assemblies are commonly used to damp high frequency pressure oscillations in gas turbine combustor assemblies. Because the resonator assemblies for controlling high frequency pressure oscillations are typically compact, they can be easily located on the combustor assembly liners. A known resonator assembly comprises a resonator outer plate having a plurality of generally circular openings closely spaced relative to one another and positioned over substantially the entire surface area of the outer plate, a resonator side wall coupled to the resonator outer plate, and a resonator inner plate defined by a portion of the liner. The resonator inner plate is provided with a plurality of closely spaced openings that are located over substantially the entire surface area of the inner plate. Air is supplied through the openings in the outer plate, into an inner cavity defined by the resonator inner and outer plates and side wall and then through the openings in the resonator inner plate. The plurality of resonator assemblies are spaced apart circumferentially about the liner and are generally positioned in alignment in an axial direction.

A thermal barrier coating is applied to a substantial portion of the inner surface of the liner to protect the liner from the hot combustion products passing therethrough. However, the thermal barrier coating can lengthen a neck of each Helmholtz resonator assembly, thus altering its damping performance. Therefore, prior to applying the thermal barrier coating to the liner inner surface, masking material is typically applied over the area where the openings are located so as to prevent thermal barrier coating material from being applied to the inner surfaces of the resonator inner plates. Since the resonator inner plates include a plurality of closely spaced openings, it is impractical to mask only the areas adjacent to the openings while leaving the areas between the openings unmasked. Therefore masking material is typically applied in a circumferential band to the inner surface of the liner. This masking technique prevents thermal barrier coating material from being applied in the areas adjacent to the resonator assembly openings, but also prevents the thermal barrier coating from being applied to the areas between resonator assemblies. Those unprotected portions of the liner inner surface are exposed to the hot combustion products passing through the liner and, as a result, require cooling air that flows through the resonator assemblies. A minimum amount of cooling air is required to prevent overheating of the liner, which may result in thermal fatigue of the liner and part failure.

SUMMARY OF THE INVENTION

In accordance with a first aspect of the present invention, a combustor assembly is provided comprising a combustor casing; a liner coupled to the combustor casing; a burner assembly coupled to the combustor casing; and at least one resonator assembly. The resonator assembly comprises a resonator outer plate having at least one opening, a resonator side wall coupled to the resonator outer plate, and a resonator inner plate defined by a portion of the liner. The resonator inner plate is coupled to the resonator side wall and has at least one slot formed therein having an aspect ratio of at least 4:1.

The liner comprises a closed curvilinear liner such as a generally cylindrical liner.

In accordance with one embodiment of the present invention, the slot in the resonator inner plate may extend in a circumferential direction of the generally cylindrical liner.

The one opening in the resonator outer plate may be located along an axis generally parallel to and axially spaced from the slot in the resonator inner plate extending in the circumferential direction of the generally cylindrical liner.

The one opening in the resonator outer plate may comprise a slot. Alternatively, the at least one opening in the resonator outer plate may comprise a plurality of openings located along the axis generally parallel to and axially spaced from the slot in the resonator inner plate.

In accordance with a further embodiment of the present invention, the slot or slots in the resonator inner plate may extend in an axial direction of the generally cylindrical liner.

The at least one opening in the resonator outer plate may be located along an axis generally parallel to and circumferentially spaced from the slot in the resonator inner plate extending in the axial direction of the generally cylindrical liner.

The at least one opening in the resonator outer plate may comprise a slot.

Alternatively, the at least one opening in the resonator outer plate may comprise a plurality of openings located along the axis generally parallel to and circumferentially spaced from the slot in the resonator inner plate.

The resonator inner plate may have at least 50% of its inner surface coated with thermal barrier coating material.

In accordance with a second aspect of the present invention, a process is provided for forming a plurality of resonator assemblies comprising: providing a generally cylindrical liner having a plurality of slots, each having an aspect ratio of at least 4:1; providing a plurality of resonator outer plates, each having at least one opening; providing a plurality of resonator side walls, each being coupled to a corresponding one of the resonator outer plates; coupling each of the resonator side walls to an outer surface of the liner such that each side wall encompasses a corresponding one of the slots; applying masking material to portions of an inner surface of the liner near the slots while leaving an unmasked portion located between adjacent masked portions; applying a thermal barrier coating on the inner surface of the liner; and removing the masking material from the liner inner surface such that the thermal barrier coating does not cover the portions to which the masking material was applied.

Applying masking material comprises applying the masking material so as to encompass each of the slots in the generally cylindrical liner. Preferably, the masking material extends away from each of the slots no more than about 4 mm.

DETAILED DESCRIPTION OF THE INVENTION

In the following detailed description of the preferred embodiments, reference is made to the accompanying drawings that form a part hereof, and which is shown by way of illustration, and not by way of limitation, specific preferred embodiments in which the invention may be utilized and that changes may be made without departing from the spirit and scope of the present invention.

Figure 1:
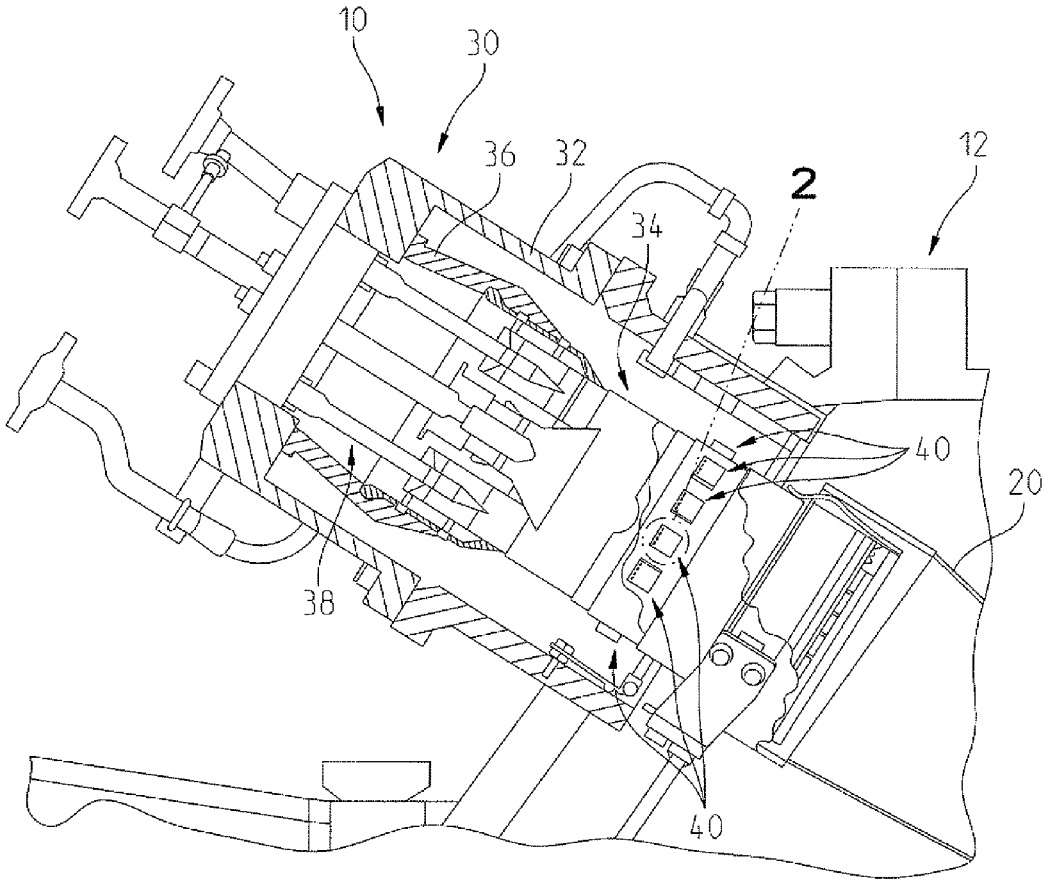
FIG. 1 is a side view, partially in cross section, of a combustor assembly constructed in accordance with the present invention.

A portion of a can-annular combustion system 10, constructed in accordance with the present invention, is illustrated in FIG. 1. The combustion system 10 forms part of a gas turbine engine. The gas turbine engine further comprises a compressor (not shown) and a turbine (not shown). Air enters the compressor, where it is compressed to elevated pressure and delivered to the combustion system 10, where the compressed air is mixed with fuel and burned to create hot combustion products defining a working gas. The working gases are routed from the combustion system 10 to the turbine. The working gases expand in the turbine and cause blades coupled to a shaft and disc assembly to rotate.

The can-annular combustion system 10 comprises a plurality of combustor assemblies 30 and a like number of corresponding transition ducts 20. The combustor assemblies 30 and transition ducts 20 are spaced circumferentially apart so as to be positioned about an outer shell 12 of the gas turbine engine. Each transition duct 20 receives combustion products from its corresponding combustor assembly 30 and defines a path for those combustion products to flow from the combustor assembly 30 to the turbine.

Only a single combustor assembly 30 is illustrated in FIG. 1. Each of the combustor assemblies 30 forming part of the can-annular combustion system 10 may be constructed in the same manner as the combustor assembly 30 illustrated in FIG. 1. Hence, only the combustor assembly 30 illustrated in FIG. 1 will be discussed in detail here.

The combustor assembly 30 comprises a combustor casing 32 coupled to the outer shell 12 of the gas turbine engine, see FIG. 1. The combustor assembly 30 further comprises a liner 34, a burner assembly 38 and a plurality of resonator assemblies 40, see FIG. 1. The liner 34 is coupled to the combustor casing 32 via a support member 36. In the illustrated embodiment, the liner 34 comprises a closed curvilinear liner such as a generally cylindrical liner. The burner assembly 38 is coupled to the combustor casing 32 and functions to inject fuel into the compressed air such that it mixes with the compressed air. The air and fuel mixture burns in the liner 34 and transition duct 20 so as to create hot combustion products.

A plurality of resonator assemblies 40 constructed in accordance with a first embodiment of the present invention are spaced apart circumferentially about the liner 34, see FIG. 1. For example, there may be between about 4 and about 30 resonator assemblies 40 associated with the liner 34. The resonator assemblies 40 comprise Helmholtz resonators and function to control or damp combustion acoustic pressure oscillations generated during combustion of the air and fuel mixture. See U.S. Pat. No. 6,530,221, the disclosure of which is incorporated by reference herein, for a further discussion of Helmholtz resonators. Each resonator assembly 40 is constructed in the same manner. Hence, only the resonator assembly 40 illustrated in FIG. 2 will be described in detail herein.

Figure 2:
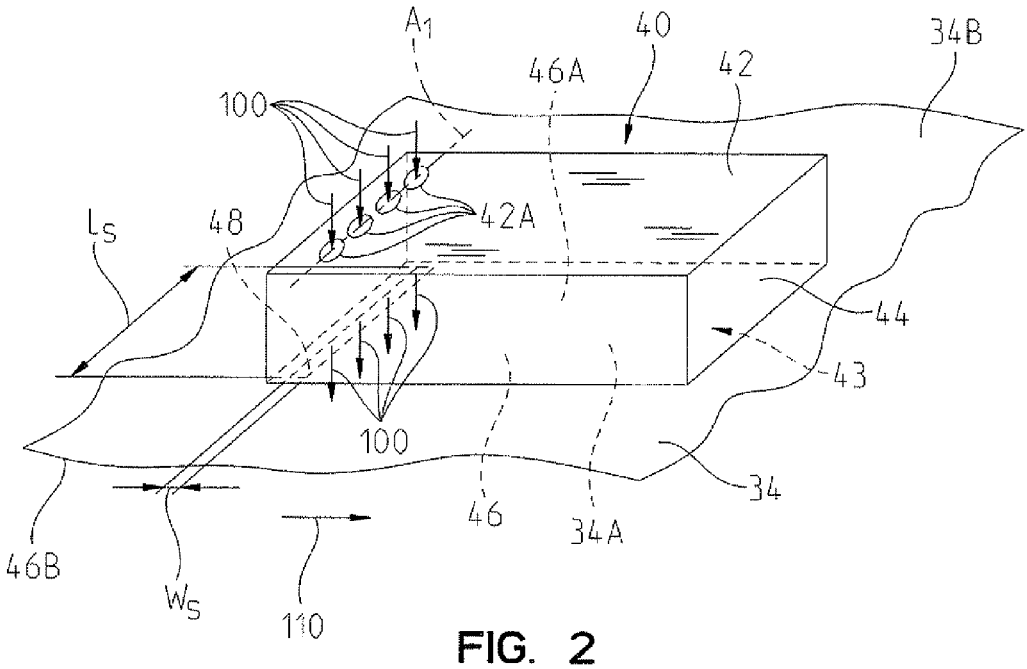
FIG. 2 is a perspective view of a resonator assembly constructed in accordance with a first embodiment of the present invention.

The resonator assembly 40 comprises a resonator outer plate 42 having a plurality of openings 42A, which, in the illustrated embodiment, are elliptical and aligned along an axis $A_1$, see FIG. 2. Alternatively, the openings 42A may be circular, square, triangular, or have any other geometric shape. Further, the openings 42A may be spaced apart over the entirety of the resonator outer plate 42. The assembly 40 further comprises a resonator side wall 44 and a resonator inner plate 46. The resonator side wall 44 is coupled to or formed integral with the resonator outer plate 42. The resonator inner plate 46 is defined by a portion 34A of the liner 34. The resonator side wall 44 is coupled to the resonator inner plate 46 such as by welds. The inner plate 46 has a generally rectangular slot 48 formed therein with an aspect ratio of at least 4:1, i.e., a length $L_S$ of the slot 48 is at least 4 times larger than a width $W_S$ of the slot 48. The generally rectangular slot 48 may have corners that are formed to define a substantially 90 degree angle. It is also contemplated that the generally rectangular slot 48 may have corners that are curved. In the illustrated embodiment, the slot 48 extends generally circumferentially about the liner 34 and is generally parallel with axis $A_1$. The combustion gases flow axially within the liner 34 as indicated by arrow 110 in FIG. 2. While only a single slot 48 is shown in the illustrated embodiment, it is contemplated that the resonator inner plate 46 may have more than one slot 48. As indicated by arrows 100, cooling air flows through the openings 42A in the resonator outer plate 42, into an inner cavity 43 defined by the outer plate 42, the side wall 44 and the inner plate 46 and through the slot 48 in the inner plate 46. The cooling air functions to cool an outer surface 46A of the resonator inner plate 46 as well as portions of an inner surface of the inner plate 46, such as inner surface portions near the slot 48.

Figure 3:
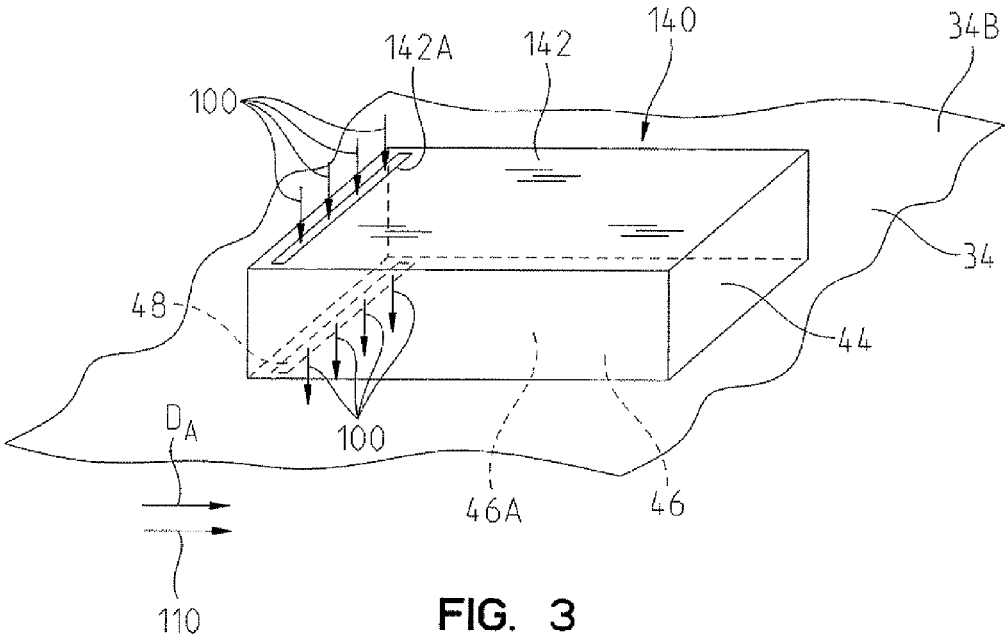
FIG. 3 is a perspective view of a resonator assembly constructed in accordance with a second embodiment of the present invention.

A resonator assembly 140 constructed in accordance with a second embodiment of the present invention is illustrated in FIG. 3, wherein like reference numerals indicate like elements. The resonator assembly 140 is substantially similar to the resonator assembly 40 illustrated in FIG. 2, except that a slot 142A is provided in the outer plate 140 instead of a plurality of openings 42A. While only a single slot 142A is illustrated in FIG. 3, more than one slot 142A may be provided. In the illustrated embodiment, the slot 48 extends generally circumferentially about the liner 34. The slot 142A is generally parallel to the slot 48 and also generally aligned to the slot 48 in an axial direction $D_A$.

Figure 4:
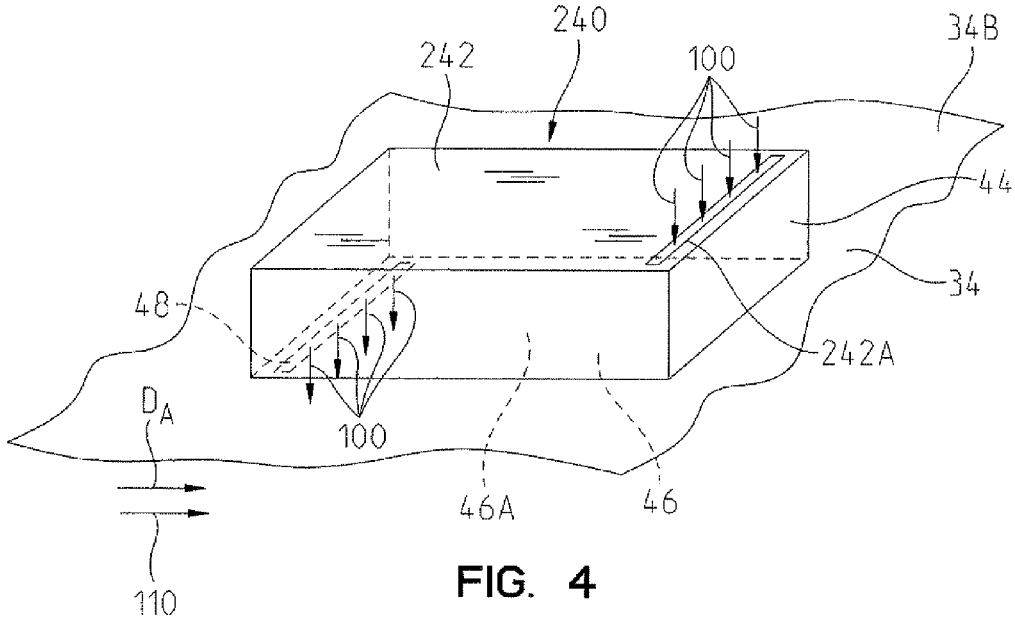
FIG. 4 is a perspective view of a resonator assembly constructed in accordance with a third embodiment of the present invention.
Figure 4A:
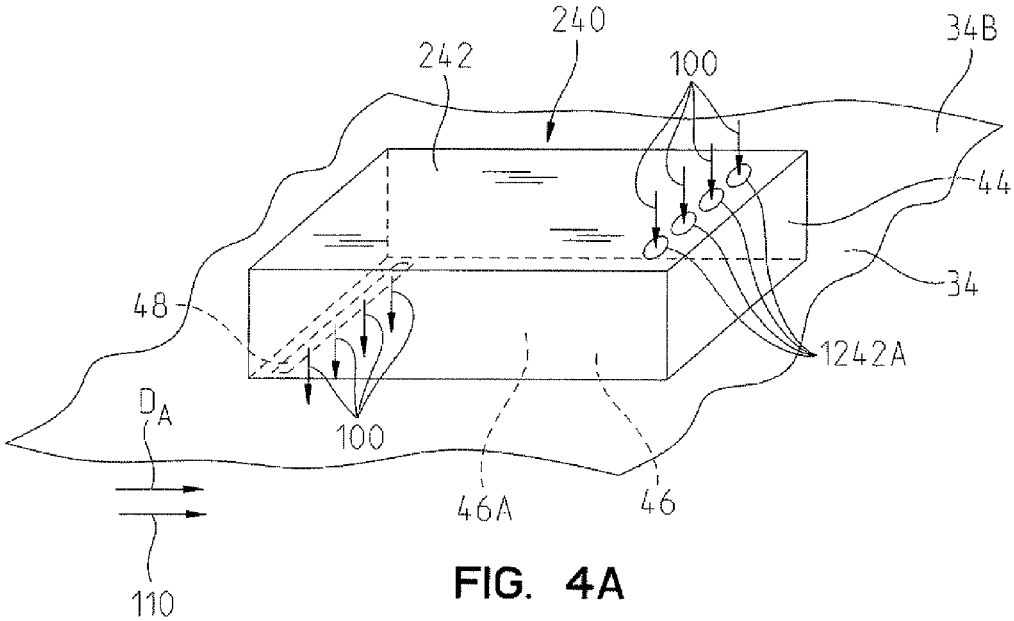
FIG. 4A is a perspective view of a resonator assembly constructed in accordance with a modified embodiment of the present invention.

A resonator assembly 240 constructed in accordance with a third embodiment of the present invention is illustrated in FIG. 4, wherein like reference numerals indicate like elements. The resonator assembly 240 is substantially similar to the resonator assembly 140 illustrated in FIG. 3, except that a slot 242A in a resonator outer plate 242 is spaced in the axial direction $D_A$ from the slot 48 provided in the resonator inner plate 46. In the illustrated embodiment, the slot 48 extends generally circumferentially about the liner 34. The slot 242A is generally parallel to the slot 48. It is further contemplated that the slot 242A may be replaced by a plurality of openings 1242A, which may be aligned along a common axis, see FIG. 4A.

Figure 5:
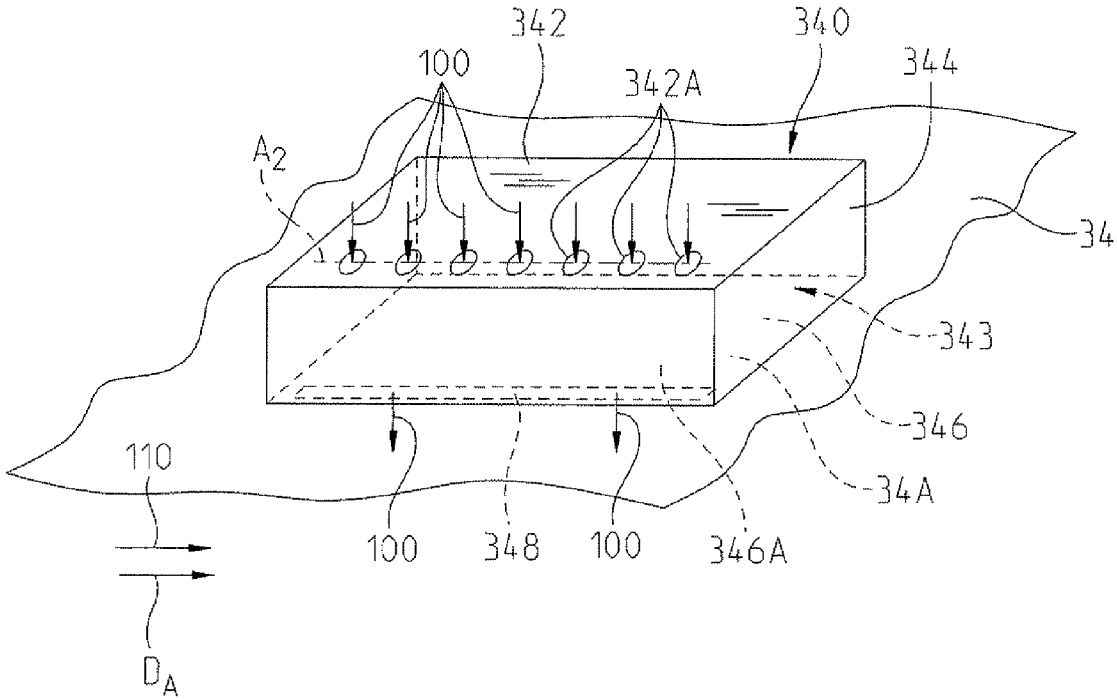
FIG. 5 is a perspective view of a resonator assembly constructed in accordance with a fourth embodiment of the present invention.

A resonator assembly 340 constructed in accordance with a fourth embodiment of the present invention is illustrated in FIG. 5, wherein like reference numerals indicate like elements. The resonator assembly 340 comprises a resonator outer plate 342 having a plurality of generally elliptical openings 342A, which, in the illustrated embodiment, are aligned along an axis $A_2$. Alternatively, the openings 342A may be circular, square, triangular, or have any other geometric shape. More than four or less than four openings 342A may be provided. Further, the openings 342A may be spaced apart over the entirety of the resonator outer plate 342. The assembly 340 further comprises a resonator side wall 344 and a resonator inner plate 346. The resonator side wall 344 is coupled to or formed integral with the resonator outer plate 342. The resonator inner plate 346 is defined by a portion 34A of the liner 34. The resonator side wall 344 is coupled to the resonator inner plate 346 such as by welds. The inner plate 346 has a generally rectangular slot 348 formed therein with an aspect ratio of at least 4:1. The generally rectangular slot 348 may have corners that are formed to define a substantially 90 degree angle. It is also contemplated that the generally rectangular slot 348 may have corners that are curved. In the illustrated embodiment, the slot 348 extends generally in the axial direction $D_A$ and is generally parallel with axis $A_2$. The combustion gases flow axially within the liner 34 as indicated by arrow 110 in FIG. 5. While only a single slot 348 is shown in the illustrated embodiment, it is contemplated that the resonator inner plate 346 may have more than one slot 348. As indicated by arrows 100, cooling air flows through the openings 342A in the resonator outer plate 342, into an inner cavity 343 defined by the outer plate 342, the side wall 344 and the inner plate 346 and through the slot 348 in the inner plate 346. The cooling air functions to cool an outer surface 346A of the resonator inner plate 346 as well as portions of an inner surface of the inner plate 346, such as inner surface portions near the slot 348.

Figure 6:
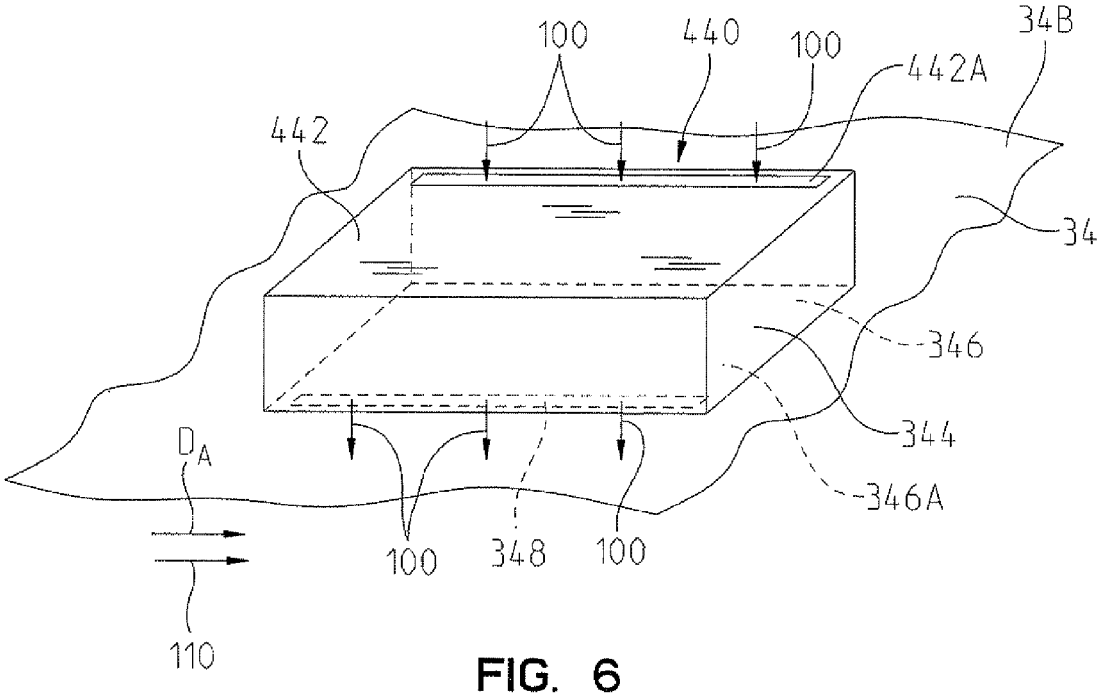
FIG. 6 is a perspective view of a resonator assembly constructed in accordance with a fifth embodiment of the present invention.

A resonator assembly 440 constructed in accordance with a fifth embodiment of the present invention is illustrated in FIG. 6, wherein like reference numerals indicate like elements. The resonator assembly 440 comprises a slot 442A provided in the resonator outer plate 442. While only a single slot 442A is illustrated in FIG. 6, more than one slot 442A may be provided. In the illustrated embodiment, the slot 442A extends generally axially along the liner 34 and is generally circumferentially spaced from the slot 348.

A process for forming the combustor assembly 30 including a plurality of resonator assemblies 440 will now be described. A generally cylindrical liner 34 formed, for example, from a high temperature metal alloy, is provided having a plurality of slots 348. The slots 348 are spaced apart circumferentially about the liner 34 by a distance $D_1$. Distance $D_1$ may be equal to or greater than about three times a width $W_2$ of each slot 348, wherein the slot width $W_2$ may be from about 0.5 mm to about 10 mm. Each slot 348 preferably has an aspect ratio of at least 4:1. A plurality of resonator side walls 344, each coupled to a corresponding outer plate 442, are coupled, such as by welding, to an outer surface 34B of the liner 34 so that each side wall 344 encompasses a corresponding one of the slots 348.

Figure 7:
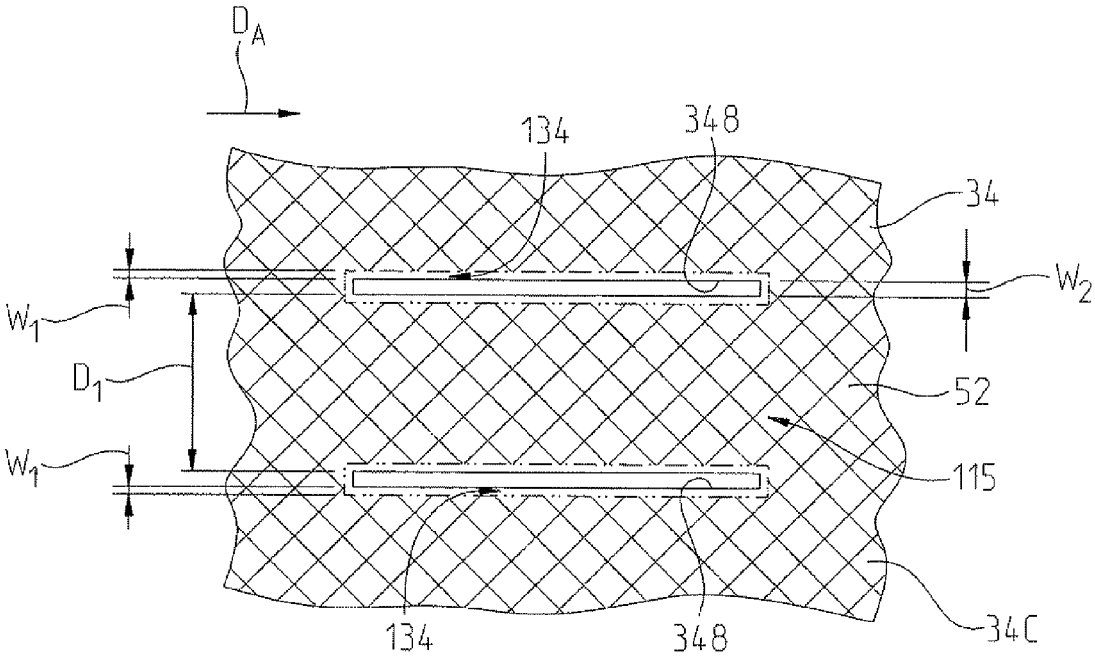
FIG. 7 is a view of a portion of an inner surface of a liner of the combustor assembly illustrated in FIG. 1.

Masking material (not shown), such as plug capable of being inserted into each slot 348, is provided so as to overlap portions 134 of an inner surface 34C of the liner 34 where thermal barrier coating material is not to be applied, see FIG. 7. In the illustrated embodiment, each masking material plug is located around a corresponding slot 348 so as to extend outwardly from each slot a width of from about 0.5 mm to about 4 mm. Thereafter, thermal barrier coating material 52 is applied to substantially the entire inner surface 34C of the liner 34. The masking material plugs are then removed. Hence, the previously masked inner surface portions 134 are not covered by thermal barrier coating material. The inner surface portions 134 in the illustrated embodiment, may have a width $W_1$ of between about 0.5 mm to about 4 mm, see FIG. 7.

In the illustrated embodiment, an area 115 extending between each pair of slots 348 in the circumferential direction is substantially covered by thermal barrier coating material 52, see FIG. 7. This is in contrast to the prior art combustor assemblies discussed above where masking material was typically applied in a circumferential band so as to prevent thermal barrier coating material from being applied to the inner surfaces of the resonator inner plates. The band of masking material also prevented thermal barrier coating material from coating areas positioned between the plurality of openings located over substantially the entire surface area of the inner plate. In the present invention, because masking material is only applied to the portions 134 of the inner surface 34C of the liner 34, wherein the portions 134 extend about each of the slots 348 and have a limited size, i.e., a width extending away from an edge of a corresponding slot 348 of no more than about 4 mm, most of the area 115 of the inner surface 34C of the liner 34 located between the slots 348 is covered with thermal barrier coating material. It is preferred that at least 50% of the inner surface of the resonator inner plate 346 be coated with thermal barrier coating material. Because of the shape of the slots 348, masking of each resonator inner plate 346 is easier to effect.

Hence, during operation of the combustion assembly 30 a greater amount of the inner surface 34C of the liner 34 is protected from high temperature combustion gases as compared to the prior art combustor assemblies where masking material was typically applied in circumferential bands.

A process similar to one discussed above with regard to FIG. 7 may be used to form the combustor assembly 30 including a plurality of resonator assemblies 240, see FIG. 4. A generally cylindrical liner 34 formed, for example, from a high temperature metal alloy, is provided having a plurality of slots 48. The slots 48 are spaced apart axially from one another by a distance which may be equal to or greater than about three times a width of each slot 48, wherein the slot width is from about 0.5 mm to about 10 mm. Each slot 48 preferably has an aspect ratio of at least 4:1. A plurality of resonator side walls 44, each coupled to a corresponding outer plate 242, are coupled, such as by welding, to an outer surface 34B of the liner 34 so that each side wall 44 encompasses a corresponding one of the slots 48.

Masking material (not shown), such as plug capable of being inserted into each slot 48, is provided so as to overlap portions of an inner surface 34C of the liner 34 where thermal barrier coating material is not to be applied. In the illustrated embodiment, each masking material plug is located around a corresponding slot 48 so as to extend outwardly from the slot 48 a width of from about 0.5 mm to about 4 mm. Thereafter, thermal barrier coating material 52 is applied to substantially the entire inner surface 34C of the liner 34. The masking material plugs are then removed. Hence, the previously masked inner surface portions are not covered by thermal barrier coating material. The previously masked inner surface portions in the illustrated embodiment, may have a width of between about 0.5 mm to about 4 mm.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A combustor assembly comprising:
a combustor casing;
a liner coupled to said combustor casing;
a burner assembly coupled to said combustor casing; and
a plurality of resonator assemblies, each resonator assembly comprising a resonator outer plate having at least one opening, a resonator side wall coupled to said resonator outer plate, and a resonator inner plate defined by a portion of said liner, said resonator inner plate being coupled to said resonator side wall and having a single slot extending across a surface of said resonator inner plate having an aspect ratio of at least 4:1.

2. The combustor assembly as set out in claim 1, wherein said liner comprises a closed curvilinear liner.

3. The combustor assembly as set out in claim 1, wherein said liner comprises a generally cylindrical liner.

4. The combustor assembly as set out in claim 3, wherein said slot in said resonator inner plate extends in a circumferential direction of said generally cylindrical liner.

5. The combustor assembly as set out in claim 4, wherein said at least one opening in said resonator outer plate is located along an axis generally parallel to and axially spaced from said slot in said resonator inner plate extending in the circumferential direction of said generally cylindrical liner.

6. The combustor assembly as set out in claim 5, wherein said at least one opening in said resonator outer plate comprises a slot.

7. The combustor assembly as set out in claim 5, wherein said at least one opening in said resonator outer plate comprises a plurality of openings located along the axis generally parallel to and axially spaced from said slot in said resonator inner plate.

8. The combustor assembly as set out in claim 3, wherein said slot in said resonator inner plate extends in an axial direction of said generally cylindrical liner.

9. The combustor assembly as set out in claim 8, wherein said at least one opening in said resonator outer plate is located along an axis generally parallel to and circumferentially spaced from said slot in said resonator inner plate extending in the axial direction of said generally cylindrical liner.

10. The combustor assembly as set out in claim 9, wherein said at least one opening in said resonator outer plate comprises a slot.

11. The combustor assembly as set out in claim 9, wherein said at least one opening in said resonator outer plate comprises a plurality of openings located along the axis generally parallel to and circumferentially spaced from said slot in said resonator inner plate.

12. The combustor assembly as set out in claim 1, wherein said resonator inner plate has at least 50% of its inner surface coated with thermal barrier coating material.

13. The combustor assembly as set out in claim 1, wherein said at least one opening in said resonator outer plate comprises one of a single slot and a single row of openings aligned with one another along a common axis.

14. The combustor assembly as set out in claim 13, wherein said at least one opening in said resonator outer plate is offset from said single slot formed in said resonator inner plate.

15. A combustor assembly comprising:
a combustor casing;
a liner coupled to said combustor casing;
a burner assembly coupled to said combustor casing; and
a plurality of circumferentially aligned resonator assemblies, each resonator assembly comprising a resonator outer plate having at least one opening, a resonator side wall coupled to said resonator outer plate, and a resonator inner plate defined by a portion of said liner, said resonator inner plate being coupled to said resonator side wall and having a single slot extending across a surface of said resonator inner plate, wherein at least 50% of a surface of said liner between said slots of adjacent circumferentially aligned resonator assemblies is coated with thermal barrier coating material.

16. A combustor assembly comprising:
a combustor casing;
a liner coupled to said combustor casing;
a burner assembly coupled to said combustor casing; and
at least one resonator assembly comprising a resonator outer plate having at least one opening comprising one of a single slot and a single row of openings aligned with one another along a common axis, a resonator side wall coupled to said resonator outer plate, and a resonator inner plate defined by a portion of said liner, said resonator inner plate being coupled to said resonator side wall and having at least one slot extending across a surface of said resonator inner plate that is not aligned with said at least one opening in said resonator outer plate.

17. The combustor assembly as set out in claim 16, wherein said at least one slot formed in said resonator inner wall has an aspect ratio of at least 4:1.

18. The combustor assembly as set out in claim 16, wherein said at least one slot formed in said resonator inner wall comprises a single slot.

19. The combustor assembly as set out in claim 16, wherein said liner comprises a generally cylindrical liner and said at least one slot in said resonator inner plate extends in a circumferential direction of said generally cylindrical liner.

20. The combustor assembly as set out in claim 16, wherein said liner comprises a generally cylindrical liner and said at least one slot in said resonator inner plate extends in an axial direction of said generally cylindrical liner.

* * * * *